United States Patent [19]

Davidson

[11] 4,206,521

[45] Jun. 10, 1980

[54] BULKHEAD FOR SWIMMING POOLS

[76] Inventor: Dekkers H. Davidson, 420 Nannyhagen Rd., Thornwood, N.Y. 10594

[21] Appl. No.: 947,289

[22] Filed: Sep. 29, 1978

[51] Int. Cl.[2] ..... E04H 3/16; A47K 3/14

[52] U.S. Cl. ..... 4/505; 4/514; 52/655; 405/65

[58] Field of Search ..... 4/172, 172.11–172.14, 4/183, 193; 405/6, 63, 65, 72; 9/6 R, 6 P, 8 P; 29/469; 114/61, 65 R; 52/64, 655, 694

[56] References Cited

U.S. PATENT DOCUMENTS

| | | | |
|---|---|---|---|
| 3,439,366 | 4/1969 | Matthews | 9/6 P |
| 3,562,994 | 2/1971 | Linsowe | 52/655 |
| 3,582,999 | 6/1971 | Baker | 4/172.11 |
| 3,598,686 | 8/1971 | Clark | 52/655 X |
| 3,824,796 | 7/1974 | Nasby, Jr. | 52/694 X |
| 3,842,484 | 10/1974 | Stark | 29/469 |
| 3,962,735 | 6/1976 | Davidson | 4/172.12 |
| 3,984,987 | 10/1976 | Light, Jr. | 405/63 |

*Primary Examiner*—Stuart S. Levy

*Attorney, Agent, or Firm*—A. C. Nolte, Jr.; Edward B. Hunter

[57] ABSTRACT

A bulkhead for a swimming pool has a simple, lightweight frame, improved movability within the pool and means for suppressing the ill effects of waves produced by a swimmer nearing the bulkhead.

6 Claims, 3 Drawing Figures

10
14
16
20
22
24
26
28
30
32
34
36
37
38
39
42
44
50
52
54
56
62
64
65
66
67
68
70
D
E
F

BULKHEAD FOR SWIMMING POOLS

BACKGROUND OF THE INVENTION

This invention is concerned with movable bulkheads for swimming pools. A typical prior art arrangement is illustrated in my earlier U.S. Pat. No. 3,962,735 issued June 15, 1976. Essentially, the bulkheads comprise a frame supporting a platform or walkway and having at each side of the frame a barrier wall. Conventionally, the frame has been a box frame with the barrier wall means constituting frame support elements, or a double truss arrangement has been used in which the trusses are disposed at opposite longitudinal edges of the platform or a composite truss has been used with the trusses again disposed at the longitudinal edges of the platform. It has been conventional to assemble the bulkhead prior to delivery to the pool site and, upon delivery to the pool, to install the assembled structure. This is in many instances both cumbersome and difficult since the structures are relatively large.

Additionally, the bulkheads usually have a depth only slightly less than the minimum depth of the pool and with existing barriers this means that while the movement of the bulkhead within the deeper portions of the pool is relatively easy, great effort is required to move the bulkhead to the shallow end of the pool since the space beneath the bulkhead for the water to move from one side to the other of that structure becomes very limited.

BRIEF SUMMARY OF THE INVENTION

The present invention seeks to provide a bulkhead of simple and lightweight structure which facilitates handling of the bulkhead and also permits the ready assembly of the bulkhead on site, in this way to avoid the difficulties discussed above. Additionally, according to the present invention, the bulkhead is provided with a flow through characteristic which facilitates the moving of the bulkhead through the pool. This feature additionally assists in the suppression of waves caused by a swimmer nearing the bulkhead and also to this end there is provided a longitudinally extending slot in the bulkhead positioned just above the surface of the water of the pool. This slot, or rather the marginal edges defining the slot, provide a hand grip for a swimmer.

BRIEF DESCRIPTION OF THE FIGURES OF THE DRAWINGS

The present invention is illustrated, schematically, in the accompanying drawings in which.

DESCRIPTION OF THE PREFERRED EMBODIMENT

Figure 1:
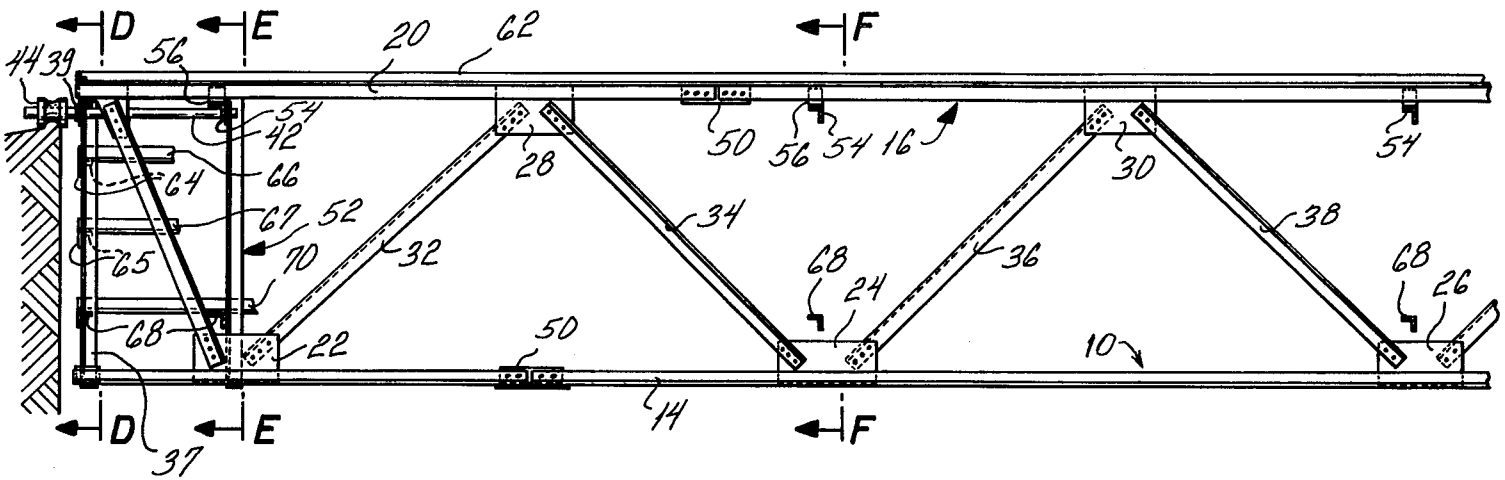
FIG. 1 is a front elevation of a bulkhead frame according to the present invention.
Figure 2:
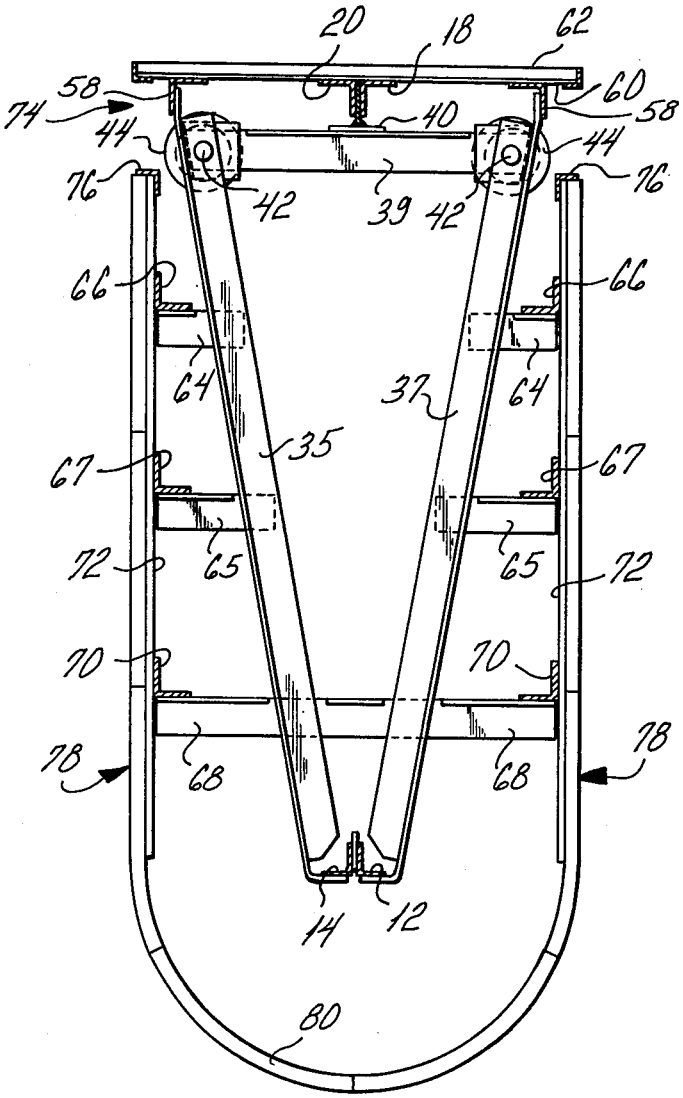
FIG. 2 is a section on the line D—D of FIG. 1.
Figure 3:
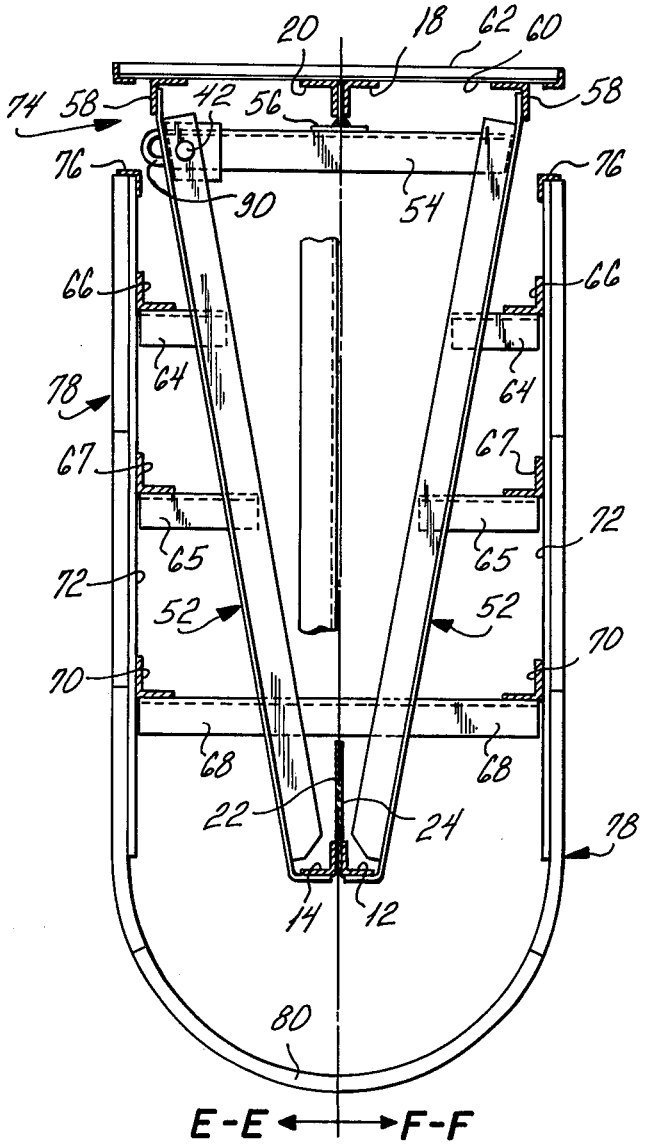
FIG. 3 is a composite section of the bulkhead of which the frame is illustrated in FIG. 1, that part of FIG. 3 to the left of the center line being a section on the line E—E and that part of FIG. 3 to the right of the center line being a section on the line F—F of FIG. 1.

The main truss of the bulkhead of this invention is illustrated in FIG. 1 and comprises a lower chord 10 comprising, as can be seen in FIGS. 2 and 3 a pair of structural stainless steel angles 12 and 14. An upper chord indicated at 16 is made up, again as can be seen in FIGS. 2 and 3, of a pair of structural angles 18 and 20.

Between the adjacent flanges of angles 12 and 14 at spaced intervals therealong are gusset plates 22, 24, 26, etc. and similar gusset plates 28, 30, etc. are secured to the top chord 16. Diagonal truss members 32, 34, 36, 38, etc. extend between the gusset plates to constitute, with the upper and lower chords, the main truss.

At each end of the main truss a pair of outrigger angles 35 and 37, visible in FIG. 2, are provided. The lower portions of those outriggers being secured to respective ones of the angles making up the lower chord and the upper ends of the ties 35 and 37 being secured to an angle 39 which is secured, by means of a connection element 40, to the upper chord 16. In this way, the angles 35, 37 define a generally V-shaped structure. Secured in appropriate cross members of the frame and at each end of the main truss are a pair of spaced apart axles 42 which carry grooved wheels 44 which cooperate with an appropriate configuration in the side gutter of the pool, there being four such wheels, two at each end of the truss those wheels supporting the truss, and when completed, the whole bulkhead, within the pool. It will, of course, be appreciated that when the bulkhead is assembled appropriate floatation devices can be provided within the body of the bulkhead to relieve the load on the individual wheels.

For ease in transportation and assembly, the upper and lower chords are made in several length, the individual lengths being connected to form the upper and lower chords by splice plates generally indicated at 50.

At intervals spaced along the length of the main truss, there are provided pairs of outrigger angles 52, seen particularly in FIG. 3, the lower ends of the angles 52 being secured to the bottom chord and the upper ends of those angles being connected to a cross brace 54, which in turn is connected to the top chord by connecting element 56. The pairs of angles 52 together define V-shaped structures or strut elements, which most desirably, are spaced apart by the width, in a pool utilized for racing, of a lane which is generally about seven feet.

At the upper edges of the elements 52 and extending longitudinally of the bulkhead, are pairs of angle supports 58.

Secured to the upper edges of these angles 58 and to the horizontal flanges of the angle irons making up the top girder or upper chord 16, is a perforated stainless steel sheet 60 atop which a non-slip surface 62 is disposed, the surface 62 providing the walkway of the bulkhead. The sheet 60 is welded to the angles, and thus provides horizontal resistance to bulkhead deflection from tightened racing lane dividers extending from brackets 90, and from swimmers' turns.

Secured to each of the elements 52 and projecting outwardly therefrom are bracket elements 64, each of which supports an upper longitudinally extending angle 66, the purpose of which is described hereinafter.

Towards the lowermost parts of the elements 52, cross bracing elements 68 are secured, those elements projecting to opposite sides of the elements 52 and supported at each end of each element 68 are lower longitudinally extending angles 70.

In between upper and lower longitudinally extending angles 66 and 70 are intermediate longitudinally extending angles 67 supported upon the central parts of elements 52 via brackets 65. These angles 67 and the cross bracing provided by brackets 67 add further horizontal bracing against deflection, particularly caused by tired swimmers whose leg thrusts tend to become lower and lower in the water after extensive swimming, and also provides support pieces upon which may be attached floatation elements.

At each side of the bulkhead, and secured to the angles 66, 67, and 70 is a perforated stainless steel sheet 72 which extends from approximately ½" above water level to a level close to the lower girder. The gap 74 between the platform and the upper edges of the sheet 72 serves a purpose as discussed supra in suppressing wave action by permitting a wave caused by a swimmer nearing the bulkhead to pass over and through the immediately adjacent surface of the bulkhead to be dissipated.

The upper edges of the steel sheet 72 are provided with a finishing element 76 which serves as a hand hold for a swimmer.

The outer surfaces of the sheet steel plates are clad with a non-slip, rubber based plastic coating in tile form, indicated generally at 78. The covering is U-shaped as shown with limbs extending toward the edges of the platform, and extends as indicated at 80 beneath the bulkhead and substantially precludes the possibility of a swimmer becoming trapped between the bottom of the bulkhead and the pool bottom and as it is resilient, if accidentally hit by a swimmer, the swimmer will be unharmed.

The surfacing tiles of the bulkhead barrier means are perforated and this, together with the perforations in the steel upon which those tiles are supported, serves to facilitate the moving of the bulkhead through a pool by allowing the water to pass freely from one side to the other of the bulkhead and also serves in the suppression of waves.

It will be noted that by the adoption of a single central truss, i.e. a truss central to the walkway, the ability of the truss to support a load to each side of its plane is utilized and this, of course, allows the simple lightweight frame to support the walkway. It will be appreciated that it is additionally possible to use two, or even more, vertically disposed trusses and in each instance to have the walkway extend beyond the planes of the trusses on both sides and this arrangement provides the substantial advantages over the conventional systems in terms of obtaining a lightweight yet strong structure.

It will be recognized by those skilled in the art that the frameword illustrated herein is one which can be assembled readily on site conveniently by bolting the various components together and then making adjustments to accommodate any sag in the framework or distortion and thereafter welding the components together to render the structure permanent and solid. By the adoption of this technique, since the framework as it is installed in an empty pool is supporting the maximum weight to which the structure is very likely to be subject, it is possible to achieve a rigid and level structure not always possible with a preassembled structure. It will be recognized that when the pool is filled, the weight of the structure can be controlled as desired or required by the floatation devices embodied within the bulkhead.

It will be recognized that various modifications of the equipment shown herein to accommodate different pool gutter structures, etc. are quite possible and well within the scope of the claims appended hereto.

What is claimed is:

1. In a movable bulkhead for use in a swimming pool and including means for supporting and moving said bulkhead along the sides of the pool, the improvement comprising a frame supporting a barrier and a platform supported above said barrier, said frame comprising at least one longitudinally extending vertical truss means, said platform extending to both sides of said truss means and outrigger means extending laterally from said truss means for supporting said barrier said vertical truss means comprising an upper and a lower chord, intermediate truss members connecting said chords in vertically spaced relation, said laterally extending outrigger means comprising a plurality of brace means longitudinally spaced from one another along said truss means, said outrigger means comprising strut members connected to said lower chord and extending upwardly on the sides of said truss means.

2. The bulkhead of claim 1 wherein said barrier comprises a perforated wall permitting the relatively free passage of water therethrough from one side of the barrier to the other.

3. The bulkhead of claim 2 wherein said barrier comprises a plastic sheet material disposed in a U-shaped the upper ends of said U-shaped wall being disposed adjacent said platform.

4. The bulkhead of claim 1 wherein said barrier wall means has a horizontal gap extending across the bulkhead at a location which, in use, is slightly above the level of water in the pool, said gap constituting wave suppression means.

5. The bulkhead of claim 4 wherein marginal edges of said barrier wall means adjacent said gap define hand hold means.

6. The bulkhead of claim 1 wherein each said outrigger means comprises a pair of strut members defining a V-shaped structure.

* * * * *